US008161597B2

(12) United States Patent
Witter et al.

(10) Patent No.: US 8,161,597 B2
(45) Date of Patent: Apr. 24, 2012

(54) SHOP VACUUM CLEANER WITH CYCLONIC SEPARATOR

(75) Inventors: Robert M. Witter, Syracuse, NY (US); Jeffrey Hill, Cicero, NY (US)

(73) Assignee: Oneida Air Systems, Inc., Syracuse, NY (US)

( * ) Notice: Subject to any disclaimer, the term of this patent is extended or adjusted under 35 U.S.C. 154(b) by 942 days.

(21) Appl. No.: 12/139,705

(22) Filed: Jun. 16, 2008

(65) Prior Publication Data

US 2009/0307866 A1 Dec. 17, 2009

(51) Int. Cl.
*A47L 9/10* (2006.01)

(52) U.S. Cl. ..... 15/347; 15/320; 15/323; 15/327.2; 15/329; 15/352; 15/353; 15/384

(58) Field of Classification Search ..... 15/320, 15/323, 327.2, 329, 347, 352, 384, 413, 353
See application file for complete search history.

(56) References Cited

U.S. PATENT DOCUMENTS

| | | | | |
|---|---|---|---|---|
| 2,295,984 | A * | 9/1942 | Wilson | 55/288 |
| 3,206,787 | A * | 9/1965 | Daniels et al. | 15/320 |
| 5,746,795 | A * | 5/1998 | Witter | 55/472 |
| 7,282,074 | B1 * | 10/2007 | Witter | 55/300 |
| 7,937,803 | B2 * | 5/2011 | Witter | 15/347 |
| 2006/0143853 | A1 * | 7/2006 | Agerlid et al. | 15/353 |
| 2009/0178237 | A1 * | 7/2009 | Proffitt et al. | 15/353 |

* cited by examiner

*Primary Examiner* — Robert Scruggs
(74) *Attorney, Agent, or Firm* — Bernhard P Molldrem Jr

(57) ABSTRACT

A shop vacuum cleaner has a series of dust separation stages, with the large majority of the dust being preseparated in a cyclonic separator and deposited into a first drum or barrel. The remaining dust is carried in the air stream is filtered out in a pre-filter in a second vacuum cleaner drum. A final filter cartridge is fitted onto the intake of the vacuum head. The vacuum cleaner machine exhausts clean, filtered air into the ambient.

10 Claims, 3 Drawing Sheets

SHOP VACUUM CLEANER WITH CYCLONIC SEPARATOR

BACKGROUND OF THE INVENTION

This invention is directed to heavy-duty vacuum cleaners of the type used in woodshops, machine shops, or for industrial applications, and commonly referred to as shop vacuums or shop vacuum cleaners. The invention is more particularly concerned with a shop vacuum in which there are a series of dust separation stages, with the large majority of the dust being deposited into a drum or barrel, and with the remaining dust that is carried in the vacuum machine air stream being filtered out in a pre-filter and in a final filter, so that the vacuum cleaner machine exhausts clean, filtered air into the ambient.

Shop vacuum cleaners are often employed for picking up dust that has accumulated on the shop floor and on surfaces of equipment, or may also be connected to a dust outlet of a dust-producing tool, i.e., wood working machines, such as sanders, joiners, and the like, or machines that process metals, plastics, or other composites such as concrete or stone. In these shop vacuum devices, a vacuum head, which sits on top of a drum or barrel, a blower that is powered by an electric motor induces a suction to draw a stream of air into the machine. The airstream is then directed into the barrel, where dust collects. The air stream then passes though a bag filter or other filter, and is exhausted to the ambient.

In most cases, the shop vacuum filter does not filter out fine dust, and there is always at least some of the dust that passes out and back into the ambient air. This airborne fine dust can present a health hazard, and in a woodshop environment is a serious quality issue as the airborne dust can contaminate varnish or other wood finish.

The dust that is collected can quickly clog and blind the filter also, which limits air flow and diminishes the efficiency of the shop vacuum. Moreover, filling of the filter material requires that the vacuuming operation be interrupted frequently for cleaning and/or replacing of the filter.

A shop-type vacuum cleaner with a cartridge type final filter to capture fine dust particles has been proposed previously, and an example of such a shop vacuum is described in U.S. Pat. No. 5,069,696. In that case, an externally-mounted filter is located in the exhaust air stream in a housing that is disposed outside the vacuum machine drum or canister. This arrangement exhausts significantly cleaner air back into the ambient, but because the air passes directly from the main collection drum out to the filter housing, the filter accumulates dust quickly and requires frequent cleaning for effective operation.

It has been proposed previously to employ a cyclonic separator in line in a vacuum hose in advance of a shop vacuum cleaner for pre-separating particulate matter, and then connecting the outlet pipe of the cyclonic separator to the inlet of the vacuum cleaner. This arrangement is described, for example, in U.S. Pat. No. 7,282,074. This system can result in removal of about ninety percent, or more, of the dust from the air stream ahead of the vacuum cleaner, so that the vacuum cleaner operates longer and more efficiently in most applications. However, this arrangement requires attaching the cyclone as a separate element in between the shop vacuum cleaner and the dust producing tool or dust pick-up tool.

OBJECTS AND SUMMARY OF THE INVENTION

Accordingly, it is an object of this invention to combine a shop vacuum with a high energy efficiency cyclonic separator to create an improved dust collection device that avoids the drawbacks of the prior art.

It is a more specific object to provide a shop vacuum cleaner which efficiently removes nearly all of the dust from the vacuum air stream, and returns clean, filtered air to the ambient.

It is a further object of this invention to provide a shop vacuum cleaner which can operate for an extended period without need to unclog or clean the exhaust air filter.

According to an aspect of the invention, a shop vacuum cleaner has a series of dust collection stages. A primary dust collection barrel is employed for receiving the vast majority of the dust from the vacuum cleaner air stream. A lid member is adapted to fit onto the upper rim of said primary dust collection barrel, with a generally flat plate member, typically a steel disk, and an annular flange fitting over (or in some cases fitted within) the barrel upper rim. This can employ the usual sealing member for creating an environmental seal against the barrel rim, and clamp members for holding the lid member in place against the rim of the barrel.

A cyclonic separator is mounted directly on the top of the lid member on the flat plate portion thereof. An air inlet port for receives a flexible vacuum intake hose that carries the stream of air with entrained dust and dirt. The separator has a conic chamber receiving airflow from the air inlet port, and has its nose end at the bottom, facing the barrel. A dust outlet at the nose end communicates through an opening in the lid member with the interior of the primary dust collection barrel. Also, a vortex tube at an upper end extends from within the cyclonic chamber and serves as an air outlet.

A secondary dust collection drum is mounted (or formed) atop the flat plate member of the lid member, and this drum having a generally circular upper rim for receiving the vacuum head. The drum also has an inlet duct penetrating the side wall of said drum.

A secondary conduit (typically a flexible vacuum hose) connects the air outlet at the top of the cyclonic separator with the inlet duct of the secondary dust collection drum. A pre-filter dust collection bag is situated inside the secondary dust collection drum and is fitted on the inlet duct. The vacuum head is seated atop the secondary dust collection drum. This vacuum head has a housing with a lower face fitting onto the upper rim of the secondary dust collection drum. Inside the housing are a vacuum blower (or blowers), drive motors and controls, as needed. A vacuum intake duct is positioned at the lower face of the vacuum head for drawing air from the interior of the secondary dust collection drum. The vacuum head and secondary drum have clamping devices to hold the head in place, and a sealing ring or gasket forms an environmental seal between the vacuum head and the upper rim of the drum.

A final filter cartridge, favorably a cylindrical HEPA filter cartridge, is positioned over the vacuum intake duct of said vacuum head within the secondary dust collection drum, and is secured so as to form a seal against the lower face of the vacuum head.

In operation of the multiple-stage shop vacuum, the air stream containing entrained dust passes from the flexible intake hose first into the cyclonic separator, where the vast majority of the dust is separated out and drops into the primary dust collection barrel. Then, the air stream continues through the secondary conduit and then through the pre-filter bag within the secondary dust collection drum, and the majority of the remaining particles are trapped and held within the pre-filter bag. The air flow continues through the final filter cartridge and through the intake duct of the vacuum head. The final filter picks up the remaining fine dust particles. Then the vacuum head exhausts clean, filtered air into the ambient.

As a means for securing the final filter cartridge sealably against the lower face of the vacuum head, a preferred embodiment includes a generally cylindrical sealing collar extending down from the lower face of the vacuum head to mate with an annular surface of said cartridge. A yoke fitted against the lower face of the vacuum head mounts an upper end of a threaded post, and the final filter cartridge is held in place, using a finger-secured nut threadably mounted onto the post.

The pre-filter bag can preferably be a semi-circular paper filter bag, although in some cases a cloth bag or a bag of another shape could be employed.

Also, in preferred embodiments of this shop vacuum cleaner, the primary dust collection barrel can include a hold-down feature for securing a flexible film bag liner within the barrel. This hold-down feature can include a vacuum conduit penetrating a lower portion of said barrel, and an air distributing pad within said barrel to protect the liner from ripping when vacuum is applied from the vacuum conduit. The vacuum conduit can extend from the vacuum head, or from the intake duct on the secondary drum. Alternatively, a secondary vacuum source could be used. The air distributing pad can preferably take the form of a flat open-cell foam pad, e.g., a foam disk, laid on the base of said barrel. The vacuum conduit includes a cut-off valve for blocking application of vacuum to the barrel, for example, when a bag liner is not used.

A dolly can be affixed onto the base, or an array of wheels or rollers, for supporting the barrel on the floor surface, and to permit the shop vacuum to be rolled around the area to be cleaned.

In a preferred arrangement a short electrical cord extends from the vacuum head, terminating in a plug. This plug is then plugged in to an electrical outlet box that is mounted on (or incorporated into) the lid portion. A second, longer electric cord extends from that electrical outlet box. This arrangement avoids having to have a separate extension cord, and allows the vacuum head to be removed when necessary.

This multiple-stage shop vacuum provides a convenient and an efficient dust collection system for general cleaning, and can be used also for collecting production dust from a dust producing tool. The shop vacuum arrangement of this invention can operate continuously for long periods without interruption, as about 95 to 99 percent of the collected dust is separated out by the cyclonic separator and deposited in the primary dust collection barrel, and the majority of the remaining dust is collected in the pre-filter bag. The pre-filter bag can be changed quickly and without difficulty when needed, and the final filter can also be easily cleaned, when needed. There is increased fire safety, as the dust, which may present a danger of flame or explosion, is blocked from re-entering the ambient air. Industrial hygiene is vastly improved, as well.

The above and many other objects, features, and advantages of this invention will become apparent from the ensuing detailed description of one preferred embodiment, which is illustrated in the accompanying Drawing.

DETAILED DESCRIPTION OF A PREFERRED EMBODIMENT

Figure 1:
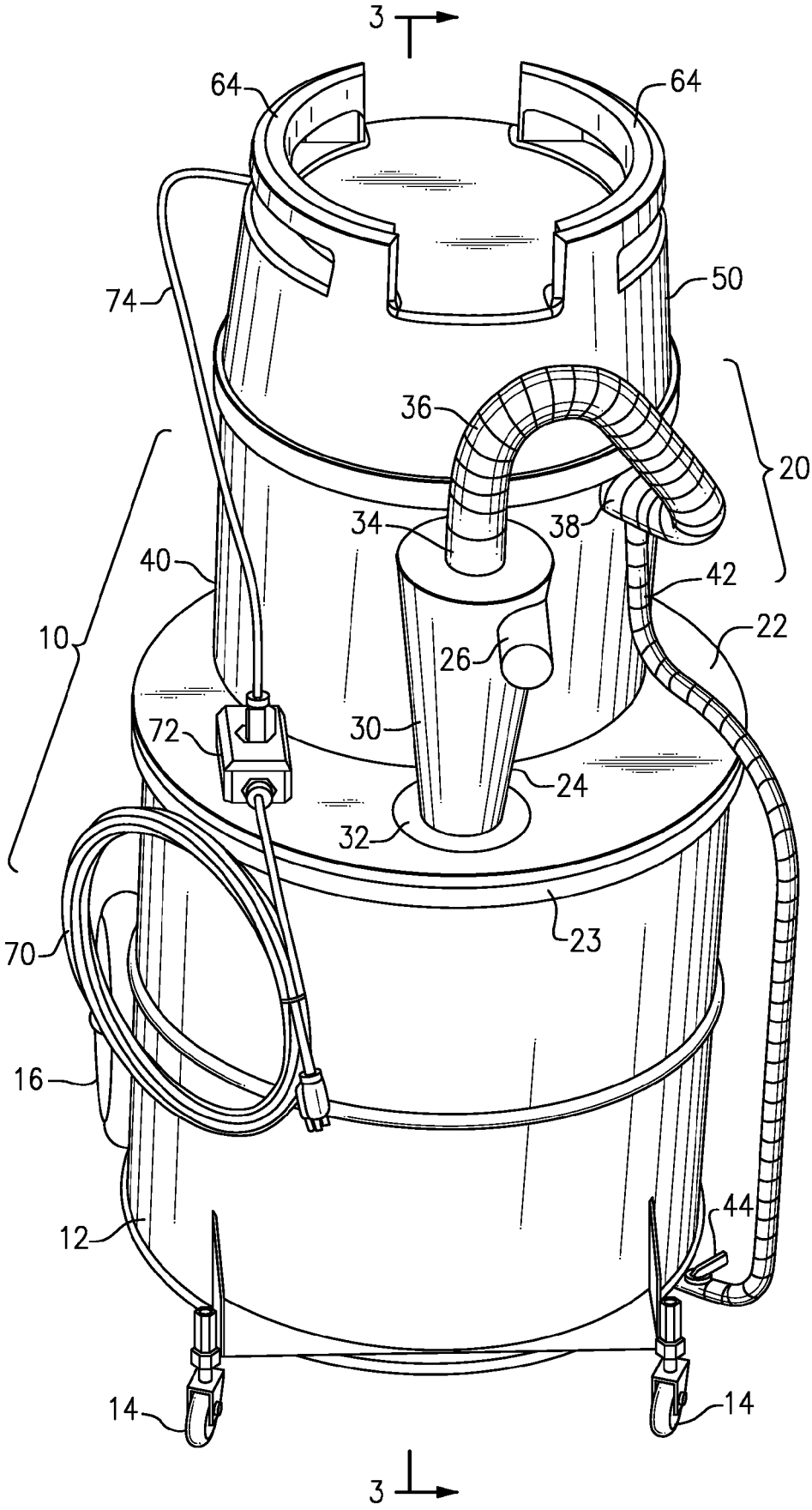
FIG. 1 is a front perspective system view of a shop vacuum cleaner device according to one embodiment of this invention.
Figure 2:
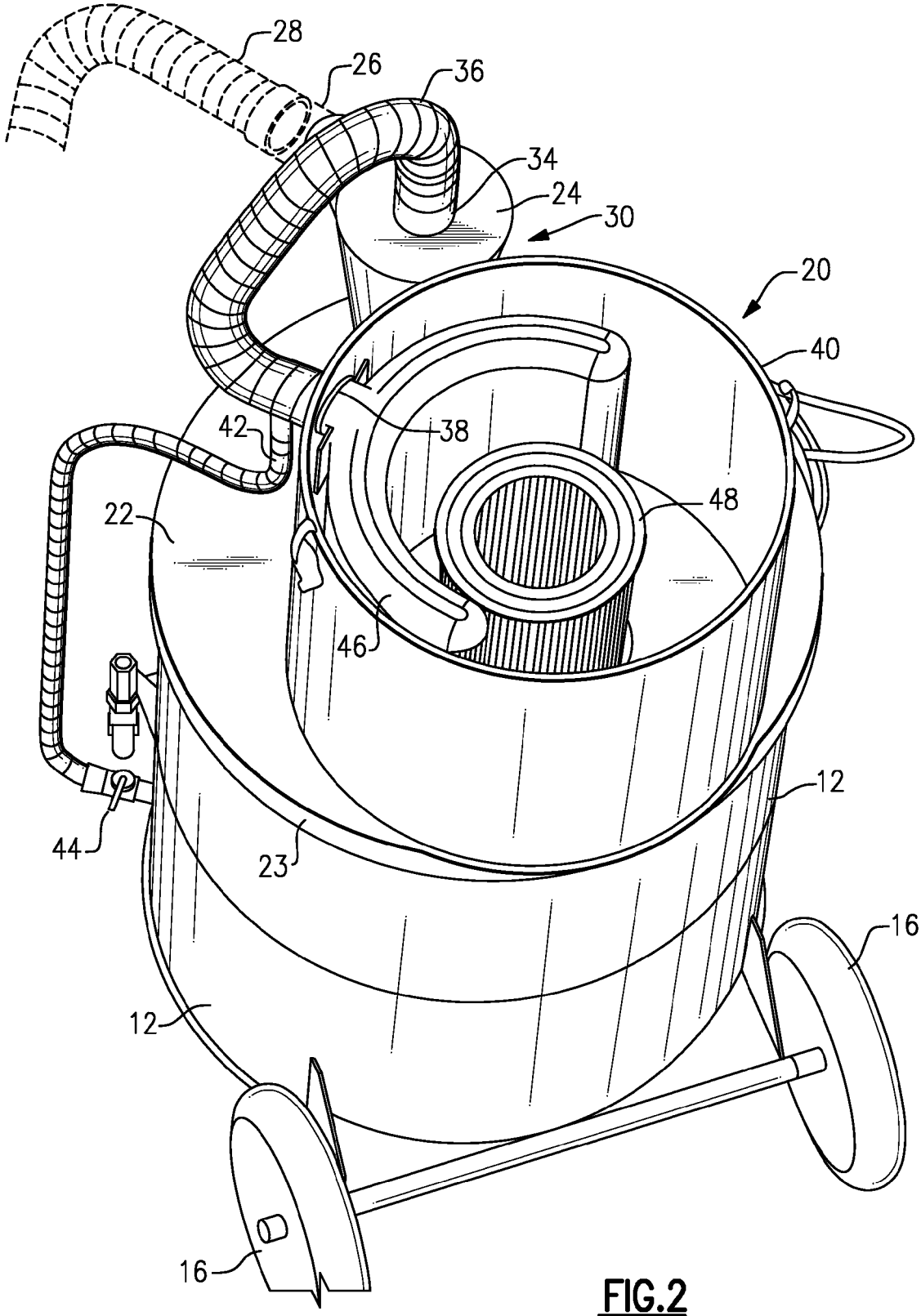
FIG. 2 is an rear perspective view of the device, with the vacuum head removed and showing the interior of the secondary dust collection drum thereof.
Figure 3:
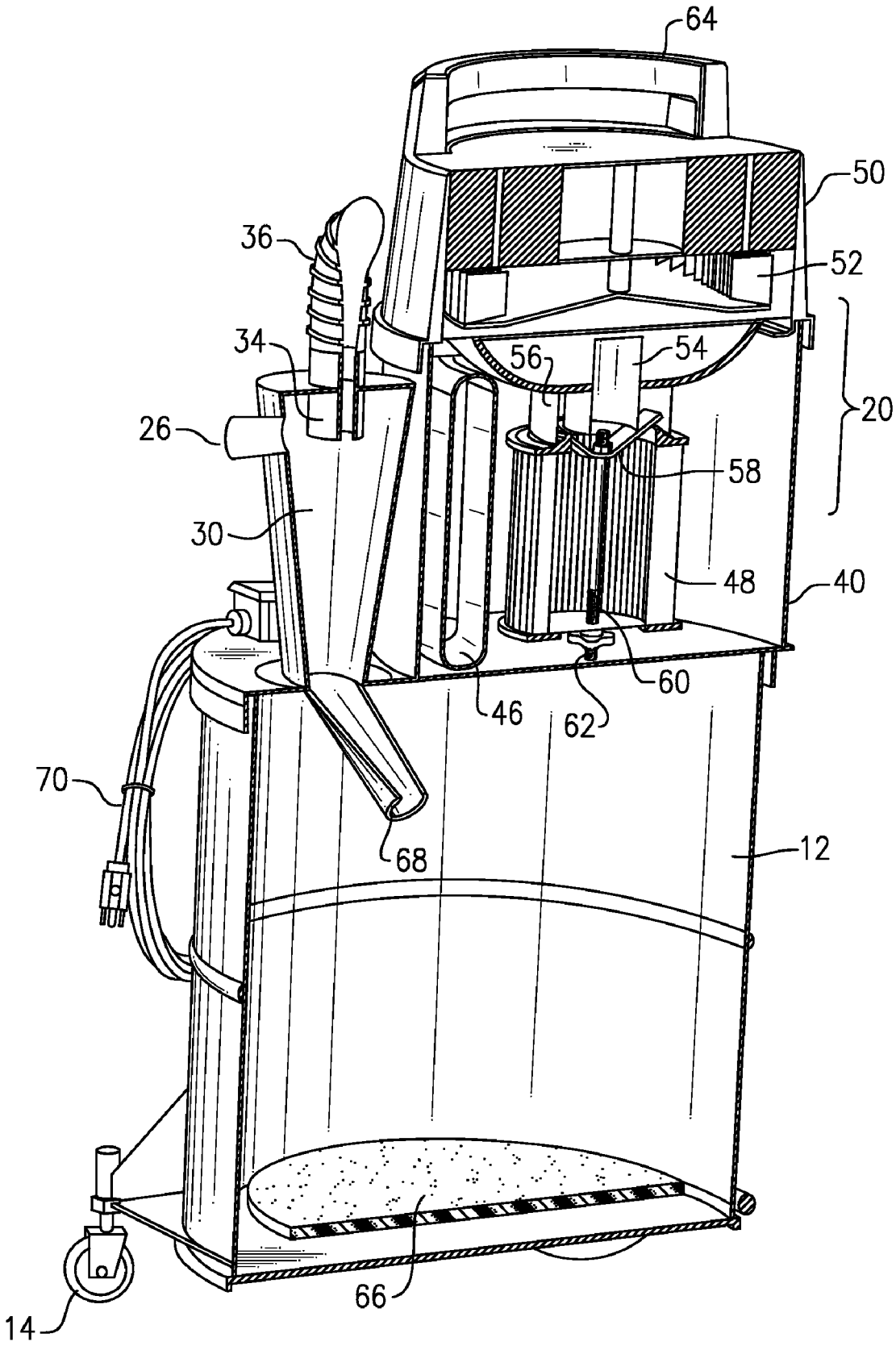
FIG. 3 is a cut-away elevational view thereof, taken at lines 3-3 of FIG. 1.

Now, with reference to the Drawing, FIGS. 1 to 3 show the three-stage shop vacuum cleaner 10 according to an embodiment of this invention in which dust is cyclonically separated from the air flow, with the leaving air being cleaned in a pre-filter and final filter and returned to the ambient as clean, filtered air.

The shop vacuum cleaner has a lower primary dust collection drum or barrel 12, which can be a 55-gallon barrel or 30-gallon barrel, for example, with a set of front wheels or rollers 14 and a set of rear wheels 16, with plates and gussets attaching the wheels to the barrel 12. An upper vacuum cleaner assembly 20 overfits onto the barrel 12, and has a barrel lid portion 22 in the form of a flat disk or plate, with an annular flange 23 for mounting over the generally circular upper rim or lip of the barrel 12. There are clamps (not shown) for securing the lid portion 22 onto the barrel, and also a rubber or rubber-like seal (not shown) inside the flange 23 to seal against the rim of the barrel. A poly bag liner (not shown) can be installed within the barrel 22 for holding the dust that falls into the barrel. This is often preferred as it facilitates removal by sealing and lifting out the bag liner.

A pre-vacuum cyclonic separator or cone 24 is mounted onto the upper side of the lid 22 at the front side of the vacuum cleaner machine. The cyclonic separator 24 may optionally be provided with a barrel or cylindrical portion at its upper side. An inlet pipe or tube 26 enters into the upper part of the separator 24, and a flexible vacuum hose 28 (FIG. 2) connects to a vacuum pickup head or dust producing tool (not shown) and fits onto the exterior part of the inlet pipe 26. The hose is generally an elongated plastic tubular member, and in some cases may incorporate a conductive material to help dissipate static buildup. The interior of the separator 24 defines a conic separation chamber 30, with a narrow end or nose at its base. The nose communicates through an opening in the plate portion of the lid 22, so that dust that separates out in the chamber 30 can descend down into the barrel 12. A flat ring 32 at the nose end of the separator serves as mounting plate and attaches onto the plate portion of the lid 22, e.g., by rivets, bolts, or by welding.

A vortex tube 34 extends down into the upper part of the conic chamber 30 and also extends up above, where it serves as an outlet port, to which one end of an intermediate hose 36 is connected. The hose 36 has its other end fitted onto an inlet pipe 38 for an upper, second dust collection drum 40. This drum is generally cylindrical in shape, with a cylindrical wall that is penetrated by the pipe 38, and has a generally circular upper rim. This drum 40 is formed or affixed onto the upper surface of the lid portion 22, just behind the cyclonic separator 24.

A small-diameter hold-down vacuum hose 42 connects from this point down to the base of the barrel 12, to provide a vacuum to the interior of the drum to hold the poly drum liner against the walls of the drum. This connects to a fitting (not shown) that penetrates the drum 12 at the base thereof. A cutoff valve 44 is disposed in line in this hose 42 to block the vacuum from the drum, when appropriate (e.g., when the liner is not being used).

The interior of the upper dust collection drum 40 can be seen in FIGS. 2 and 3. A pre-filter paper vacuum bag 46 is fitted onto the inlet pipe 38 on the interior of the drum 40. This is favorably a semi-circular or C-shaped bag, which wraps partly around a HEPA cartridge filter 48 that is located at the center of the drum 40.

A vacuum head 50 fits onto the upper rim of the drum 40, and includes a vacuum fan or blower 52 (or blowers), and the required electric motor(s) and controls. The head has a lower face that faces downward at the top of the drum 40, and there is a vacuum inlet tube 54 leading from here up to the blower (s). A circular or annular collar 56 surrounds the inlet tube 54 and mates with an upper sealing surface of the filter cartridge 48.

As a means for holding the filter cartridge in place against the lower face of the vacuum head 50, a yoke 58 is attached to the head at the inside of the collar 56, and this yoke supports a vertical threaded rod 60. A retainer nut 62 has female threads that mate with this rod 60 and this is turned down to hold the filter cartridge 48 in place on the rod. There may be a hold-down disk and other members provided, as need be. Alternatively, the filter may be held in place with a clamp or clamps that fit over the outside of the filter cartridge.

Also shown are lift handles 64 formed at the upper side of the vacuum head 50, to assist in lifting the vacuum head off the drum when it is necessary to change the pre-filter bag 46 or to change or clean the filter cartridge 48. An array of clamps are provided on the side wall of the drum 40, and corresponding structure on the rim of the vacuum head 50, as is conventional, for securing the vacuum head in place on the second dust collection drum 40.

A thin disc-shaped pad 66 of an open cell foam is laid upon the base of the barrel 12, and this serves to distribute the vacuum being applied via the hold-down hose 42, to prevent the poly bag liner from ripping or tearing when vacuum is applied.

Also shown in FIG. 3 is an angled scoop or ramp 68 that angles down (e.g., at 45 degrees) from the mouth of the separator 24 towards the center of the barrel 12. This ensures that the dust lands towards the center of the barrel, and the barrel fills evenly. Also, a coat of wax may be applied to the underside of the barrel lid 22 to keep the dust from clinging to it.

A long electrical cord 70 is shown here coiled, and terminating in an electrical outlet box 72 that is mounted or formed on the barrel lid 22. A short electrical cord 74 extends from the vaccum head 50 and plugs into the outlet box 72.

In operation, a stream of air that is picked up by the vacuum tool, with entrained dust particles, travels through the intake vacuum hose and enters through the inlet tube 24 into the conic chamber 30 of the cyclonic separator. The air stream then proceeds on a downward spiral path towards the lower nose of the cyclone. The dust separates against the side of the chamber 30, and descends down, out the lower nose and into the lower dust collection barrel 12. The air stream, from which the large majority of air has been separated, then proceeds up the center of the cyclone, and out the vortex tube 34, through the intermediate hose 36, and into the second dust collection drum 40. There the pre-filter bag 46 picks up much or most of the remaining dust in the air stream, and the air stream passes through the HEPA final filter cartridge 48, and then out through the vacuum head 50. The air exhausted from the unit into the ambient is clean, filtered air, with over 99 percent of the dust separated from the air stream.

The operator can use this vacuum cleaner for an extended period of time, and does not need to interrupt the operation for the purpose of unclogging or emptying bags or filters. There is improved fire safety as combustible dust particles are entirely filtered out and contained, and are kept from the ambient air. The high-efficiency cyclone separator has a low pressure drop and does not diminish the performance of the vacuum head 50. The filter service interval is also very long, and pressure loss through the filter cartridges is also kept low, due to the efficiency of the pre-separation cyclone and the pre-filter bag. The filtration of air and separation of dust vastly improves the industrial hygiene for the operators.

In this preferred embodiment, vacuum has a performance capacity of about 220 CFM, and a maximum water lift of 80 inches. The vacuum head 50 employs dual vacuum motors, with a power of 1800 watts, operating on line power of 110 VAC, drawing 12 amperes. The filter cartridge 48 is a HEPA pleated cylindrical cartridge final filter, with a filtration effectiveness of 99.97% for particles 0.3 microns or above. The barrel 12 as illustrated has dust capacity of 55 gallons. The sound level generated by this embodiment is only about 78 dBA, due to the muffling effect of the cyclone 24 and HEPA cartridge filter 48. The entire shop vacuum system has a footprint of only 31 inches by 27 inches, allowing it to pass through most doorways, and fitting easily onto any van or truck for transport. In the 55 gallon version as illustrated, the vacuum cleaner has a height of 61 inches. The 30 gallon version is somewhat shorter.

While the invention has been described hereinabove with reference to a few preferred embodiments, it should be apparent that the invention is not limited to such embodiments. Rather, many variations would be apparent to persons of skill in the art without departing from the scope and spirit of this invention, as defined in the appended claims.

We claim:

1. A shop vacuum cleaner having multiple successive dust collection stages, comprising;

a primary dust collection barrel having a side wall and a base defining an interior, and having a generally circular upper rim;

a lid member adapted to fit onto the upper rim of said primary dust collection barrel, including a generally flat plate member having a peripheral edge and an annular flange fitting onto said upper rim;

a cyclonic separator mounted directly atop said lid member on said flat plate thereof within said peripheral edge, including an air inlet port for receiving a flexible intake hose, a conic chamber receiving said airflow from said air inlet port, with a nose end at a bottom thereof; a dust outlet at said nose end communicating through an opening in said lid member with the interior of said primary dust collection barrel; and a vortex tube at an upper end and extending from within a cyclonic chamber thereof, the vortex tube serving as an air outlet;

a secondary dust collection drum mounted atop the flat plate member of said lid member within the circumferential edge thereof and alongside the cyclonic separator, and having a generally circular upper rim, the drum including an inlet duct penetrating said side wall of said drum;

a secondary conduit connecting the air outlet of said cyclonic separator with the inlet duct of said secondary dust collection drum, such that air flows from said air outlet into the inlet duct of said secondary dust collection drum;

a pre-filter dust collection bag mounted on said inlet duct inside said secondary dust collection drum;

a vacuum head having a housing with a lower face fitting onto the upper rim of said secondary dust collection drum, including a vacuum blower and a vacuum intake duct positioned at said lower face for drawing air from an interior of said secondary dust collection drum;

a final filter cartridge positioned over the vacuum intake duct of said vacuum head within said drum; and means securing the final filter cartridge sealable against the lower face of said vacuum head;

such that in operation an air stream containing entrained dust passes from said flexible intake hose into said cyclonic separator, where dust is separated out and drops into the primary dust collection barrel, the air stream continues out of said air outlet and then through the secondary conduit and then through the pre-filter bag within the secondary dust collection drum, and then through the final filter cartridge and the intake duct of the vacuum head, such that the vacuum head exhausts clean, filtered air into the ambient.

2. The shop vacuum cleaner according to claim 1 wherein said final filter cartridge includes a cylindrical HEPA filter cartridge.

3. The shop vacuum cleaner according to claim 1 wherein said means securing the final filter cartridge sealably against the lower face of the vacuum head includes a generally cylindrical sealing collar extending down from the lower face of the vacuum head to mate with an annular surface of said cartridge.

4. The shop vacuum cleaner according to claim 3 wherein said means for securing further includes a threaded post extending down from said lower face of said vacuum head, and a nut threadably mounted on said post for removably securing the final filter cartridge thereon.

5. The shop vacuum cleaner according to claim 1 wherein said pre-filter bag includes a semi-circular paper filter.

6. The shop vacuum cleaner according to claim 1 wherein said primary dust collection barrel includes a hold-down feature for securing flexible film bag liner within said drum, the hold-down feature including a vacuum conduit penetrating a lower portion of said barrel, and an air distributing pad within said barrel to protect the liner from ripping when vacuum is applied from said vacuum conduit.

7. The shop vacuum cleaner according to claim 6 wherein said air distributing pad includes a flat open-cell foam pad laid on the base of said barrel.

8. The shop vacuum cleaner according to claim 6 wherein said vacuum conduit includes a cut-off valve for blocking application of vacuum to said barrel.

9. The shop vacuum cleaner according to claim 1 said barrel further including at plurality of wheels supporting the barrel on a floor surface.

10. The shop vacuum cleaner according to claim 1 comprising a first electrical cord extending from said head and terminating in a plug; an electrical outlet box mounted on said lid portion having an outlet adapted to receive said plug; and a second electric cord extending from said electrical outlet box.

* * * * *